US007963135B1

(12) United States Patent
Tobias et al.

(10) Patent No.: US 7,963,135 B1
(45) **Date of Patent: *Jun. 21, 2011**

(54) SYSTEM FOR OBSTRUCTING MOVEMENT OF LOCK PINS

(76) Inventors: Marc W. Tobias, Sioux Falls, SD (US); Tobias Bluzmanis, Doral, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/835,323

(22) Filed: Jul. 13, 2010

Related U.S. Application Data

(63) Continuation of application No. 12/074,656, filed on Mar. 5, 2008, now Pat. No. 7,775,074.

(60) Provisional application No. 60/906,379, filed on Mar. 12, 2007, provisional application No. 60/920,305, filed on Mar. 27, 2007.

(51) Int. Cl.
*E05B 27/04* (2006.01)

(52) U.S. Cl. ..... 70/493; 70/419; 70/494; 70/495

(58) Field of Classification Search ..... 70/419, 70/376–378, 392, 409, 491–496
See application file for complete search history.

(56) References Cited

U.S. PATENT DOCUMENTS

| | | | |
|---|---|---|---|
| 1,667,223 | A | 4/1928 | Simpson |
| 3,080,744 | A | 3/1963 | Spain |
| 3,499,302 | A | 3/1970 | Spain |
| 3,499,303 | A | 3/1970 | Spain |
| 3,722,240 | A | 3/1973 | Spain |
| 3,985,010 | A | 10/1976 | Idoni |
| 3,999,413 | A | 12/1976 | Raymond |
| 4,377,940 | A | 3/1983 | Hucknall |
| 4,478,061 | A | 10/1984 | Preddey |
| 4,535,546 | A | 8/1985 | Smith |
| 4,635,455 | A | 1/1987 | Oliver |
| 4,638,651 | A | 1/1987 | Surko |
| 4,667,494 | A | 5/1987 | Joosten |
| 4,712,399 | A | 12/1987 | Mattossovich |
| 4,723,427 | A | 2/1988 | Oliver |
| 4,732,022 | A | 3/1988 | Oliver |
| 4,966,021 | A | 10/1990 | Boag |
| 5,167,171 | A | 12/1992 | Heredia |
| 5,172,578 | A | 12/1992 | Bitzios |

(Continued)

FOREIGN PATENT DOCUMENTS

| | | |
|---|---|---|
| GB | 251810 | 5/1926 |

(Continued)

OTHER PUBLICATIONS

Marc Weber Tobias, "Opening Locks by Bumping in Five Seconds or Less . . . "; Apr. 4, 2006, pp. 1-28, www.security.org.

(Continued)

*Primary Examiner* — Lloyd A Gall
(74) *Attorney, Agent, or Firm* — Jeffrey A. Proehl; Woods, Fuller, Shultz & Smith, P.C.

(57) ABSTRACT

A system for obstructing movement of a pin in a pin tumbler lock is disclosed. The system includes a pin movable in a bore in a plug of a pin tumbler lock, and the pin has a channel formed thereon for receiving a portion of a sidebar of the lock. The system further includes a blocking member mounted on the pin and configured to obstruct movement of the portion of the sidebar along the channel of the pin.

15 Claims, 3 Drawing Sheets

U.S. PATENT DOCUMENTS

| | | | | |
|---|---|---|---|---|
| 5,224,365 | A | 7/1993 | Dobbs | |
| 5,570,601 | A | 11/1996 | Field | |
| 5,956,984 | A | 9/1999 | Hughes | |
| 5,956,986 | A | 9/1999 | Vonlanthen | |
| 5,987,946 | A | 11/1999 | Watts | |
| 6,041,629 | A | 3/2000 | Hughes | |
| 6,138,486 | A | 10/2000 | Hughes | |
| 6,173,595 | B1 | 1/2001 | Hughes | |
| 6,382,007 | B1 | 5/2002 | Wright | |
| 6,477,875 | B2 | 11/2002 | Field | |
| 6,481,255 | B2 | 11/2002 | Theriault | |
| 6,490,898 | B1 | 12/2002 | Mottura | |
| 6,722,172 | B2 | 4/2004 | Pinkhasov | |
| 6,945,082 | B2 | 9/2005 | Field | |
| 7,775,074 | B1 * | 8/2010 | Tobias et al. | 70/493 |
| 7,775,075 | B2 * | 8/2010 | Grampurohit | 70/493 |
| 2004/0069030 | A1 | 4/2004 | Takadama | |
| 2005/0172688 | A1 | 8/2005 | Widen | |

FOREIGN PATENT DOCUMENTS

| | | |
|---|---|---|
| JP | 5251298 | 4/1977 |

OTHER PUBLICATIONS

Marc Weber Tobias, "Bumping of Locks: Legal Issues in the United States"; 2006; pp. 1-11, www.security.org.

* cited by examiner

SYSTEM FOR OBSTRUCTING MOVEMENT OF LOCK PINS

REFERENCE TO RELATED APPLICATIONS

This application is a continuation of U.S. patent application Ser. No. 12/074,656, filed Mar. 5, 2008 now U.S. Pat. No. 7,775,074 and claims the benefit of U.S. Provisional Application No. 60/906,379, filed Mar. 12, 2007, the disclosure of which is incorporated herein in its entirety, and U.S. Provisional Application No. 60/920,305 filed Mar. 27, 2007, the disclosure of which is incorporated herein in its entirety.

BACKGROUND

1. Field

The present disclosure relates to devices and methods for resisting the compromise of locks, and more particularly pertains to a new system for obstructing movement of pins in a lock when a sidebar of the lock engages the pins for protecting high security locks against compromise.

2. Description of the Prior Art

Locks employing pin tumblers have long been utilized for providing security for buildings such as homes and businesses. Pin tumbler locks include a plug that is inserted into a shell, and the plug may be rotated with respect to the shell when the correct key for the lock is used on the lock. The plug includes a keyway for removably receiving the blade of the key. The blade of the key engages a plurality of pin tumblers arranged along the keyway to contact the blade of the key at different and discrete locations. The pin tumblers each comprise a lower or bottom pin (sometimes referred to a key pin) that contacts the key blade, and an upper or top pin (sometimes referred to as a driver pin) that is pushed or lifted upwardly by the bottom pin. The top and bottom pins are positioned in a bore that extends from the keyway in the plug through and into the shell, and in the locked or vertical position of the plug the bores in the plug are substantially aligned with the bores in the shell.

The blade of the key is bitted, or cut, at a plurality of positions along the blade and in a unique pattern that is adapted to the configuration of the pin tumblers of that lock. The height of the bottom and top pins of each pin tumbler varies from tumbler to tumbler, so that the bitting for one position may not work for another position. The bitting at each position is such that the bottom pin is raised in the bore until the juncture between the bottom pin and the top pin lies in a shear line, which is located at the point where the bore in the plug and the bore in the shell meet. When the proper key is inserted, the junctures between the top and bottom pins are aligned with the shear line between the plug and shell, and the plug will freely rotate with respect to the shell. In other words, a key with the proper bitting places the top pins completely in the shell and the bottom pins completely in the plug, and the plug is able to rotate in this condition. The rotation of the plug may actuate a mechanism that moves, for example, a deadbolt or door latch.

High security locks are utilized to present an extremely pick resistant cylinder for commercial, government, and military applications where a high level of security against covert entry is required. Certain types of high security locks are known to utilize pin tumblers in which the bottom pins are both lifted and rotated by the interaction of the bitting of the key with the pin tumblers. In such instance a vertical aspect of the bitting of the key blade elevates the upper surface of the bottom pins to the shear line while an angular portion of the bitting rotates the pin to a particular angle.

One known high security lock structure is available from Medeco of Salem, Va., and aspects of various Medeco locks are disclosed, for example, in U.S. Pat. No. 3,499,303 and U.S. Pat. No. 3,722,240 (the disclosure of each of these patents being incorporated herein by reference in their respective entireties). In these locks, one (or more) of three available angles is employed for the angular bitting to cause the pin to rotate with respect to the bore. For example, in some of these types of locks, the pin may be rotated by the angular bitting of key to a position substantially parallel to a central axis extending substantially transverse of the blade, a position rotated twenty degrees left of the central axis or a position rotated twenty degrees right of the central axis. The rotation of the pins into their proper rotational position permits gates on the pins to be aligned so that legs on a sidebar are able to move into the gates and the sidebar can in turn be moved from a position that extends out of the plug and into the shell to a position that is retracted into the plug, thus allowing the plug to rotate with respect to the shell. Some variations of this lock, referred to as a "biaxial" design as is disclosed for example in U.S. Pat. No. 4,635,455, positional bitting is employed in which the contact surface of each pin may be located in one of two positions within the respective plug bore—either before or after the center line of the plug bore. The combination of the three rotational bittings, two positional bittings and several vertical bittings are believed to offer maximum resistance against all forms of covert entry by providing more than 46,000 sidebar codes in addition to approximately 3,000,000 theoretical combinations of vertical bitting, angular bitting, and positional bitting.

The introduction of the sidebar to high security locks provided an extremely high resistance to almost all forms of picking and decoding by locks so equipped. As a result, lock designs that employ the combination of the pin tumblers and a sidebar, such as the Medeco lock, have been considered to be the most difficult cylinders to compromise by covert means, and have been certified as meeting the criteria for UL 437 and ANSI 156.30 for high security locks. In part this certification is due to the unique sidebar design that provides a high resistance to most methods of picking and decoding. Although several tools are known to have been developed to attempt to bypass locks including the sidebar, these tools have all required a high skill level to utilize and often were not considered to be completely effective.

In 2004, the technique of "bumping" attracted worldwide attention as a "new" method of bypass for almost all of the conventional pin tumbler lock designs. This practice was apparently patented in the United Kingdom in 1925 (United Kingdom Patent No. 251,810), and had been known by locksmiths for many years. Bumping involves the use of a specially cut key that is rapidly and forcefully moved in the keyway of the lock to cause the pin tumblers to jump in the bores, and the bottom and top pins to momentarily separate, so that when rotational torque is applied to the plug, it may cause the plug to rotate when the separation between the top and bottom pins align with the shear line. This technique has placed almost all pin tumbler cylinders at risk. However, locks that employed sidebar technology were heretofore believed to be immune to being compromised by bumping. In fact, manufacturers of locks employing sidebar technology have touted this perceived immunity to the bumping technique in sales information, stating that the locks are "bump proof."

The high security locks upon which the techniques and devices of the present disclosure are effective typically implement two separate yet integrated locking systems. The first system is the conventional pin tumbler system in which a properly bitted key positions the split or juncture between the top and bottom pins with the shear line between the plug and shell.

The second system is the sidebar system in which a properly bitted key rotates the bottom pins to align side channels or gates in the pins such that the gates permit the side bar to move inwardly with respect to the plug and out of engagement with the shell. Correct alignment by rotation of each bottom pin tumbler to one of three angle positions of the key causes a gate within each pin to be aligned with the corresponding protruding leg of the sidebar. Only when the gates in all of the pins are horizontally and vertically aligned can the sidebar be retracted into the plug to allow turning by the key.

Thus, only the combination of the alignment of the split or juncture of the pins with the shear line and the ability of the side bar to move inwardly allows rotation of the plug with respect to the shell. Both of these systems must be properly aligned at the same time before the plug is allowed to rotate within the shell.

Some high security locks incorporate a third system for key control and security. The third system is a slider, which is a movable component controlled by a protrusion on the side of the correctly configured key which causes the slider to move laterally toward the rear of the keyway as the key is inserted into the keyway in order to allow (or block) the inward movement of the primary sidebar. The technology employed in such as system is disclosed, for example, in U.S. Pat. No. 6,945,082, which is incorporated herein by reference in its entirety. There are a number of different positions to which the slider can be moved by a step on a change key, a master key, or a combination thereof. The slider mechanism thus presents another security level to overcome if the lock is to be bypassed.

So-called tryout keys have been known for at least seventy-five years by locksmiths and were first developed to open motor vehicle locks by exploiting vertical tolerances between the depth increments used in a wafer lock. Basically, the tryout key is bitted at each wafer position to a depth that is halfway between two adjacent depth increments for that position, which is within the manufacturing tolerance of each of those depth increments, so that bitting the key to the halfway increment will work if either of the adjacent bit increments is correct for that position of the keyway. A total of 64 keys, for example, could open 4096 different General Motors sidebar locks in the United States in the 1960s. This comprised every possible combination of a six wafer lock with four depth increments for each wafer. Tryout keys allowed locksmiths to carry relatively few keys to open all cars.

The conventional methods of manipulating individual tumblers within a high security lock, such as the Medeco lock described above, is extremely difficult using any form of conventional pick. The lock employs security pins, paracentric keyways, and a sidebar as a secondary locking system. Newer lock designs add another layer of security by blocking the action of the sidebar unless a slider is moved to the correct position by the key, making picking of the lock by conventional means even more difficult.

The primary deterrent to picking these high security locks is the aforementioned need to rotate each bottom pin to one of three precise angles. Each lock or group of locks will have a unique sidebar code, which is the composite group of angled cuts for each pin.

Additionally, some high security locks such as the Medeco locks employ secondary channels or false gates on each pin to provide a false indication as to when the pins are in the correct rotational position to permit the sidebar fence to properly engage the pins. For an even higher level of security, the Medeco locks may employ a special bottom pin in one or more positions along the keyway that has a vertical sidebar channel that is precisely the dimension of the leg of the protruding fence. This pin, identified as an ARX by Medeco, renders all forms of manipulation almost impossible. In order to successfully bypass the security features of a high security lock, such as the Medeco Biaxial lock, two things must simultaneously occur: the bottom pins must be raised to the shear line and the pins must be properly rotated to allow the sidebar to retract. In some of the newer lock, a slider must also be positioned to allow the proper interaction of the slider fence with the gates in the pins.

Even if the precise sidebar code is known for the target lock it is virtually impossible to utilize that information during picking because of the difficulty in rotating each pin to the correct position. Picking difficulty is compounded by the use of at least two security pins which provide a false indication when they are at the shear line. The false vertical channels on each bottom pin also add to the difficulty. Finally, the blocking action of the sidebar can prevent the setting of pins at the shear line, thus effectively preventing the lock from being feel-picked.

In these respects, the system for obstructing movement of pins in a lock when a sidebar of the lock engages the pins according to the present disclosure substantially departs from the conventional concepts and designs of the prior art devices, and in so doing provides devices and methods primarily developed for the purpose of protecting high security locks against compromise.

SUMMARY

In view of the foregoing limitations and disadvantages in the known types of devices for and methods for resisting the compromise of locks, the present disclosure describes a new system for obstructing movement of lock pins which may be utilized for obstructing the movement of pins in a lock when a sidebar of the lock engages the pins for protecting high security locks against compromise.

In one aspect, the present disclosure relates to a system for obstructing movement of a pin in a pin tumbler lock. The system comprises a pin movable in a bore in a plug of a pin tumbler lock, and the pin has a channel formed thereon for receiving a portion of a sidebar of the lock. The system includes a blocking member mounted on the pin and configured to obstruct movement of the portion of the sidebar along the channel of the pin.

In another aspect, the present disclosure relates to a pin tumbler lock comprising a shell and a plug rotatably positioned in the shell, with the plug defining a keyway and at least one bore positioned along and extending away from the keyway. A sidebar is mounted on the plug, the sidebar engaging the shell to prevent rotation of the plug in the shell and being movable into the plug to permit the plug to be rotated in the shell. A bottom pin is positioned in the bore and is slidable with respect to the bore. The bottom pin has a contact surface oriented toward the keyway for contacting a key inserted into the keyway. The bottom pin has a channel formed thereon for receiving a portion of the sidebar to permit movement of the sidebar out of engagement with the shell to permit rotation of the plug in the shell. The lock further includes means for obstructing movement of the pin along the bore when a portion of the sidebar extends into the channel of the pin.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components or to the particulars of the steps set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
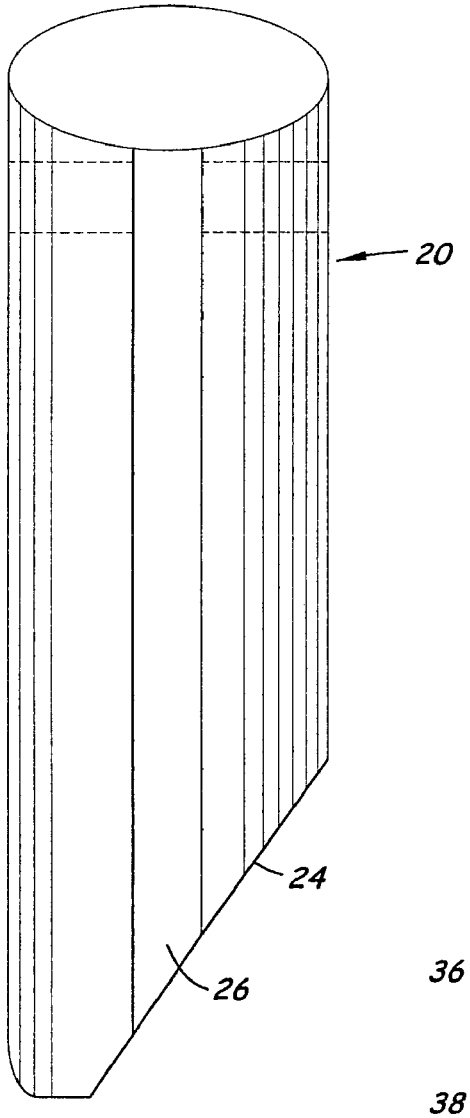
Fig. 1 (PRIOR ART)
FIG. 1 is a schematic side view of a pin suitable for application of the system for obstructing movement of a lock pin according to the present disclosure.

With reference now to the drawings, and in particular to FIGS. 1 through 7 thereof, a new system for obstructing movement of lock pins embodying the principles and concepts of the disclosed subject matter will be described.

In a co-pending patent application entitled LOCK PIN ROTATIONAL POSITION SETTING KEY AND METHOD OF USE, which was filed Mar. 5, 2008 and was assigned the application Ser. No. 12/074,657, and which is hereby incorporated herein in its entirety, we disclosed a key suitable for setting the rotational positions of the pins of high security locks that utilize pins that are rotatable as well as longitudinally moveable in the bores of the lock. As described above, the pins must be rotated to the proper rotational position as well as being lifted or moved longitudinally to the proper position in the bore in order for the plug of the lock to be rotated in the shell of the lock. In the aforementioned patent application we also disclosed a method of utilizing the sidebar, and in particular the interaction of the legs of the sidebar with the channels in the pins, to allow the longitudinal positions of the pins in the bore to be manipulated or bumped while using the sidebar to maintain or hold the rotational positions of the pins.

The present disclosure is directed to a system and method of obstructing the movement of the lock pins in the manner disclosed in our aforementioned patent application. More specifically, in some aspects, the present disclosure is directed to a device for obstructing or impeding the longitudinal (e.g., vertical) movement of the pin while the leg of the sidebar is extended into the channel of the pin, which is likely to prevent the picking or bumping of the lock in the manner disclosed in our patent application. This obstruction of the movement of the pin when the sidebar is extended into the channel is designed to impede or prevent the lifting of the pin to the shear line of the plug and shell while the sidebar maintains the rotational position of the pin. In various embodiments of the invention, an obstruction is located in the channel of the pin in order to obstruct or block movement of the leg of the sidebar by the obstruction.

The system of the present disclosure is suitable for use on a pin tumbler lock 10 (see FIG. 7) having a plug 12 that is positioned in a shell 14 in a manner so that the plug is able to rotate with respect to the shell. The plug 12 defines a keyway 16 and a plurality of bores 18 that are positioned along the keyway and extend away from the keyway. The lock 10 may include a bottom pin 20 that positioned in the bore 18. The bottom pin may be elongated and may have a generally cylindrical shape, although this shape is not critical. The bottom pin 20 is longitudinally movable, or slidable, with respect to the bore 18. The bottom pin 20 may also be rotatable with respect to the bore 18 about a longitudinal axis of the pin 20. A top pin 22 is longitudinally movable in the bore 18, and may be moved by contact with the bottom pin 20 in the bore 18.

The bottom pin 20 may have a contact surface 24 that is oriented toward the keyway 16 for contacting a key inserted into the keyway. The bottom pin 20 may have a channel 26 that is formed thereon that extends in a generally longitudinal direction of the pin 20 (see FIG. 1). The channel 26 is capable of receiving a portion of a sidebar 30 of the lock 10 to permit movement of the sidebar out of engagement with the shell 14 and thereby permit rotation of the plug 12 in the shell 14 to unlock the lock. The sidebar 30 (see FIG. 7) is normally biased outwardly into engagement with a groove 32 in the shell, and the engagement resists rotation of the plug 12 with respect to the shell 14 unless the sidebar 30 is allowed to move inwardly with respect to the plug and thereby move out of engagement with the groove 32. The camming of the sidebar 30 out of the groove 32 by inward movement is only permitted when a portion of the sidebar 30, such as a leg 34, is able to enter the channel 26 of the pin 20. The bottom pin 20 is rotatable with respect to the bore 18 to move the channel 26 into a position in which the channel is capable of receiving the leg 34 of the sidebar, thus permitting the sidebar to be cammed out of the groove in the shell when torque is applied to the plug 12. The bottom pin 20 is also rotatable into a position in which the leg 34 is incapable of being received in the channel, thus resisting the camming of the sidebar out of the groove when torque is applied to the plug.

The channel 26 may extend for a distance along a length of the bottom pin 20, and may extend substantially an entire length of the bottom pin. This elongated character of the channel 26 permits the pin to move longitudinally with respect to the bore 18 even when the leg 34 is moved into the channel, and as explained in our copending patent application, allows the manipulation of the longitudinal position of the bottom pin 20 (and the top pin 22) while the engagement of the leg 34 with the channel 26 resists rotation of the pin 20 so long as rotational torque is maintained on the plug and the sidebar is cammed inwardly with respect to the plug.

The present disclosure provides means for at least partially obstructing the portion of the sidebar 30 extending into the channel 26, such as the leg 34 of the sidebar, from being able to freely move along the length of the channel. Obstructing the free movement of the leg 34 along the channel 26 functions to obstruct the free movement of the pin 20 along the bore 18 when the leg 34 is engaged with the channel 26 of the pin. As a result, manipulation of the position of the pins 20, 22 is resisted when the leg 34 has entered the channel 26, and the camming of the sidebar 30 inwardly to hold the rotational position of the pin 20 also serves to restrict the free movement of the pin 20 in the bore 18.

It should be recognized that the obstruction of movement of the leg 34 of the sidebar 30 along the length of the channel does not have to be complete. In other words, the leg 34 does not have to be held completely stationary with respect to the channel 26 in order for the present system to be effective. The movement merely needs to be impeded sufficiently so that juncture between the top 22 and bottom 20 pins is not able to be aligned with the shear line of the plug and shell by manipulation of the pin 22.

The means for obstructing the movement may comprise a blocking member 40 (see FIGS. 2 through 6) which may be positioned on the pin 22. The blocking member 40 may be mounted on the pin 22, and may be removably mounted on the pin, although a more permanent mounted may also be utilized. The blocking member 40 may be positioned in the channel 26, and may extend across a width of the channel defined between opposite sides 36, 37 of the channel. The blocking member 40 may thus be positioned adjacent to, and may contact, the opposite sides 36, 37 of the channel.

Significantly, the blocking member 40 may be positioned at virtually any position along the channel 26, and is thus not fixed or limited to a single position in the channel. Further, the blocking member 40 may be retrofitted to the existing pins on locks already in use without making other alterations to the lock, as well as being applicable to newly manufactured locks.

Figure 2:
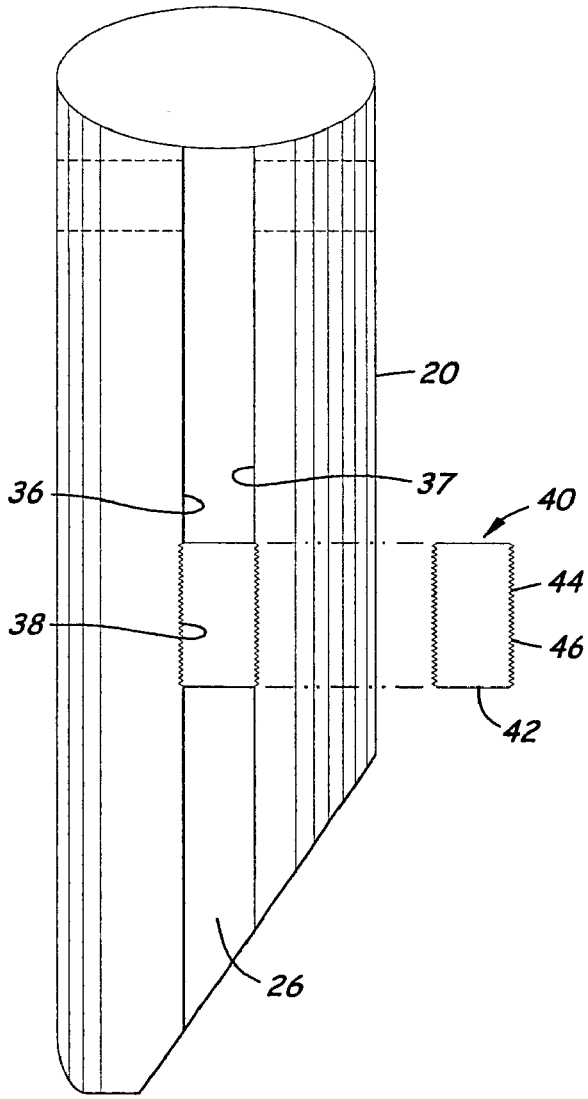
FIG. 2 is a schematic exploded side view of one embodiment of the blocking member applied to a pin of the type shown in FIG. 1.
Figure 3:
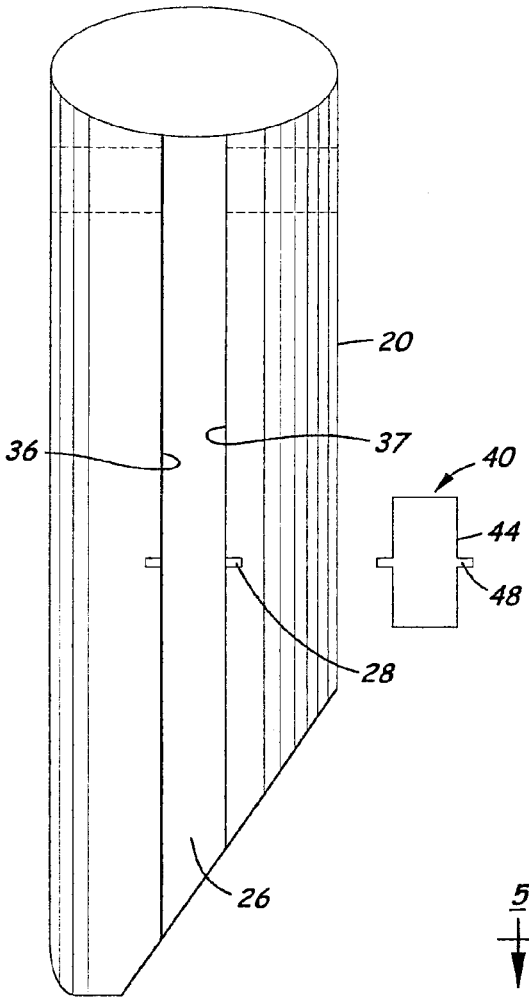
FIG. 3 is a schematic exploded view of another embodiment of the blocking member applied to a pin of the type shown in FIG. 1.

The blocking member 40 may have a perimeter 42, and the perimeter may have a shape. In various embodiments, the perimeter 42 may have a substantially rectangular shape, such as is shown in FIGS. 2 and 3. The blocking member 40 may have a perimeter edge 44. In some embodiments, at least a portion of the perimeter edge has serrations 46 for engaging complementary serrations 38 on the channel 26 of the pin, such as on the sides 36, 37 of the channel (see FIG. 2). In some embodiments, the perimeter edge 44 has at least one, and optionally more than one, tab 48 extending from the blocking member 40 to engage a recess on the pin (see FIG. 3). For example, a tab 48 may extend away from the perimeter edge 44 and may engage a recess 28 on the side 36 of the channel. It will be apparent that the tab 48 may extend from other locations on the blocking member 40, and that the recess 28 on the pin 20 may be suitably located and configured to accept the tab. The pin 20 may have one, or more than one, tab-engaging recess 28 corresponding to the tabs 48 on the blocking member 40.

Figure 4:
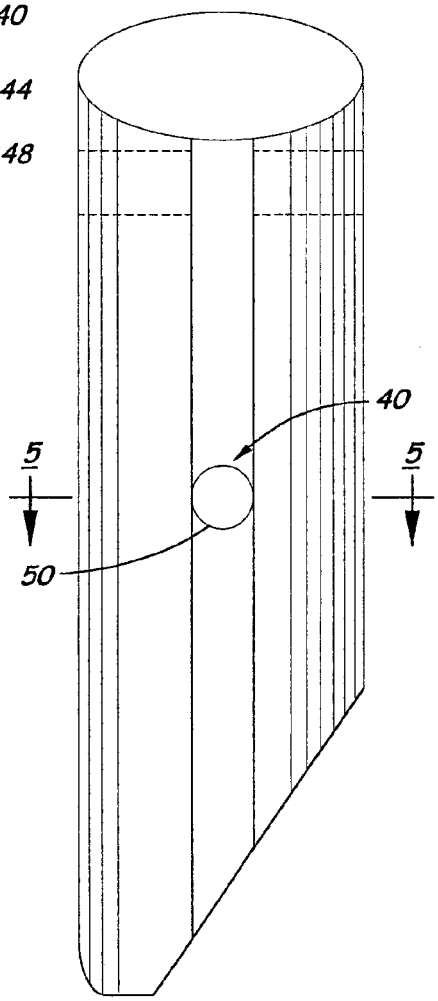
FIG. 4 is a schematic exploded side view of yet another embodiment of the blocking member applied to a pin of the type shown in FIG. 1.
Figure 5:
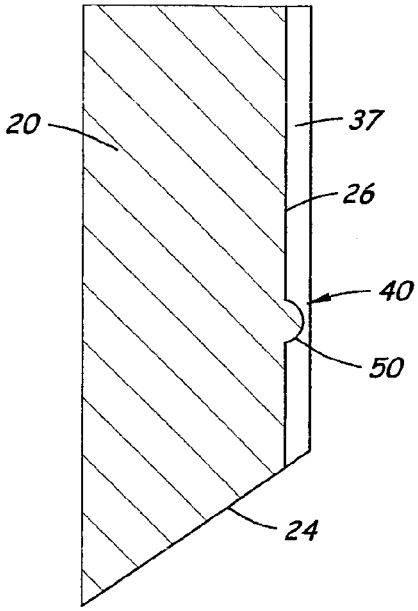
FIG. 5 is a schematic side sectional view of the pin and blocking member shown in FIG. 4 along line 5-5.
Figure 6:
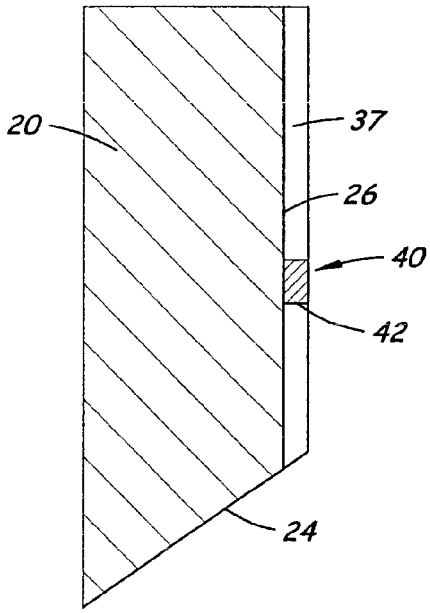
FIG. 6 is a schematic side sectional view of a pin and blocking member of the type shown in FIG. 2 or FIG. 3.
Figure 7:
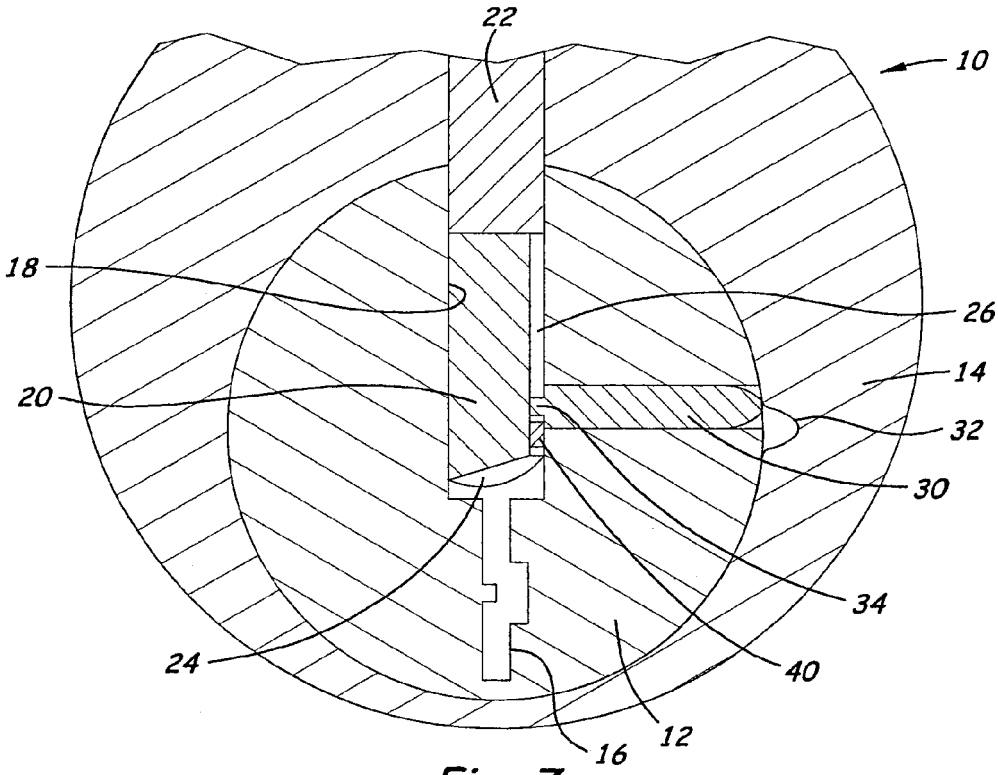
FIG. 7 is a schematic sectional view of a lock assembly including a pin including the blocking member of the present disclosure.

In some embodiments, the means for obstructing the movement may comprise a protrusion 50 of the surface of the pin 20 into the channel 26 of the pin (see FIGS. 4 and 5). The protrusion 50 may have any suitable shape, including a convex shape.

It will be recognized that the various embodiments of the blocking member 40 may not only be incorporated into newly manufactured locks, but can also be applied to previously manufactured locks by replacing the previously utilized pins with pins incorporating the blocking member, or by simply removing the existing pins and adding the blocking member 40 to the pin 20 by, for example, mounting the blocking member in the channel. In this manner, locks that have already been installed may be upgraded to include the benefits of the disclosure.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pin tumbler lock comprising:

a shell;

a plug rotatably positioned in the shell, the plug defining a keyway and at least one bore positioned along and extending away from the keyway; and a sidebar mounted on the plug, the sidebar engaging the shell to prevent rotation of the plug in the shell and being movable into the plug to permit the plug to be rotated in the shell;

a bottom pin positioned in the bore and being slidable with respect to the bore, the bottom pin having a contact surface oriented toward the keyway for contacting a key inserted into the keyway, the bottom pin having a channel formed thereon for receiving a portion of the sidebar to permit movement of the sidebar out of engagement with the shell to permit rotation of the plug in the shell; and means on the bottom pin for obstructing movement of the pin along the bore when a portion of the sidebar is extended into the channel of the pin prior to insertion of a key into the keyway to raise the pin in the bore;

wherein the means for obstructing comprises a protrusion of the surface of the pin into the channel of the pin.

2. A pin tumbler lock comprising:

a shell;

a plug rotatably positioned in the shell, the plug defining a keyway and at least one bore positioned along and extending away from the keyway; and a sidebar mounted on the plug, the sidebar engaging the shell to prevent rotation of the plug in the shell and being movable into the plug to permit the plug to be rotated in the shell;

a bottom pin positioned in the bore and being slidable with respect to the bore, the bottom pin having a contact surface oriented toward the keyway for contacting a key inserted into the keyway, the bottom pin having a channel formed thereon for receiving a portion of the sidebar to permit movement of the sidebar out of engagement with the shell to permit rotation of the plug in the shell; and means on the bottom pin for obstructing movement of the pin along the bore when a portion of the sidebar is extended into the channel of the pin prior to insertion of a key into the keyway to raise the pin in the bore;

wherein the means for obstructing comprises a blocking member extending into the channel of the pin to block sliding movement of the portion of the sidebar along the channel.

3. The pin tumbler lock of claim 2 wherein the blocking member is positioned in the channel of the pin.

4. The pin tumbler lock of claim 2 wherein the blocking member is removably mounted on the pin.

5. The pin tumbler lock of claim 2 wherein the blocking member extends across a width of the channel.

6. The pin tumbler lock of claim 2 wherein the blocking member has a perimeter edge, and at least a portion of the perimeter edge having serrations for engaging serrations formed on the channel of the pin.

7. The pin tumbler lock of claim 2 wherein the blocking member has a perimeter edge, and the perimeter edge having at least one tab extending therefrom for engaging at least one tab engaging recess in the pin adjacent to the channel.

8. A pin tumbler lock comprising:

a shell;

a plug rotatably positioned in the shell, the plug defining a keyway and at least one bore positioned along and extending away from the keyway; and a sidebar mounted on the plug, the sidebar engaging the shell to prevent rotation of the plug in the shell and being movable into the plug to permit the plug to be rotated in the shell;

a bottom pin positioned in the bore and being slidable with respect to the bore, the bottom pin having a contact surface oriented toward the keyway for contacting a key inserted into the keyway, the bottom pin having a channel formed thereon for receiving a portion of the sidebar to permit movement of the sidebar out of engagement with the shell to permit rotation of the plug in the shell, the channel includes a bottom surface and a pair of side surfaces extending from the bottom surface to define an interior of the channel in which the portion of the sidebar is able to move relative to the pin when the pin moves longitudinally in the bore; and a protrusion extending from the bottom surface of the channel into the interior of the channel between the side surfaces of the channel, the protrusion being effective to obstruct movement of the portion of the sidebar in the channel when said portion is extended into the channel of the pin prior to insertion of a key into the keyway to raise the pin in the bore and thereby effective to obstruct longitudinal movement of the pin along the bore.

9. The lock of claim 8 wherein the protrusion is formed by a blocking member mounted on the pin.

10. The lock of claim 9 wherein the blocking member extends into and is positioned in the channel of the pin to block sliding movement of the portion of the sidebar along the channel.

11. The lock of claim 9 wherein the blocking member is removably mounted on the pin.

12. The lock of claim 9 wherein the blocking member extends across a width of the channel.

13. The lock of claim 9 wherein the blocking member has a perimeter edge, and at least a portion of the perimeter edge having serrations for engaging serrations formed on the channel of the pin.

14. The lock of claim 9 wherein the blocking member has a perimeter edge, and the perimeter edge having at least one tab extending therefrom for engaging at least one tab engaging recess in the pin adjacent to the channel.

15. The lock of claim 9 wherein and the blocking member is positioned between the side surfaces of the channel.

* * * * *